US007667665B1

(12) United States Patent
Colburn et al.

(10) Patent No.: US 7,667,665 B1
(45) Date of Patent: Feb. 23, 2010

(54) DUAL FREQUENCY APERTURE ANTENNA

(75) Inventors: Joseph S. Colburn, Malibu, CA (US); Hui-Pin Hsu, Northridge, CA (US)

(73) Assignee: HRL Laboratories, LLC, Malibu, CA (US)

( * ) Notice: Subject to any disclaimer, the term of this patent is extended or adjusted under 35 U.S.C. 154(b) by 83 days.

(21) Appl. No.: 11/592,098

(22) Filed: Nov. 1, 2006

(51) Int. Cl.
*H01Q 15/18* (2006.01)
*H01Q 15/02* (2006.01)
*H01Q 19/06* (2006.01)

(52) U.S. Cl. ..... 343/911 L; 343/911 R; 343/753

(58) Field of Classification Search ..... 343/754, 343/753, 909, 911 L, 911 R
See application file for complete search history.

(56) References Cited

U.S. PATENT DOCUMENTS 5,821,908 A * 10/1998 Sreenivas ..... 343/911 R
6,606,077 B2 * 8/2003 Ebling et al. ..... 343/911 L
7,411,542 B2 * 8/2008 O'Boyle ..... 342/70

* cited by examiner

*Primary Examiner*—Hoang V Nguyen
*Assistant Examiner*—Robert Karacsony
(74) *Attorney, Agent, or Firm*—Ladas & Parry

(57) ABSTRACT

A dual frequency radar antenna for connection to a first radar transmitter/receiver set which operates in a relatively lower frequency band and to a second radar transmitter/receiver set which operates in a relatively higher frequency band. The dual frequency radar antenna has a spherical dielectric lens having a first array of inputs coupled with the first radar transmitter/receiver set and a second array of inputs coupled with the second radar transmitter/receiver set. The spherical dielectric lens forms relatively higher frequency beams that are relatively tightly spaced about a centerline of the spherical dielectric lens while the spherical dielectric lens also forms relatively lower frequency beams that are relatively farther spaced about a centerline of the spherical dielectric lens than are the relatively higher frequency beams.

10 Claims, 2 Drawing Sheets

— — — Short-Range Radar System

..... Long-Range Radar System

DUAL FREQUENCY APERTURE ANTENNA

TECHNICAL FIELD

This disclosure describes an antenna that simultaneously provides multi-beam coverage at two frequencies with two different sets of coverage area requirements. In particular, at one frequency (the lower frequency) the antenna covers a relatively large angular range with a fixed number of beams and at the second frequency (the higher frequency) the antenna covers a smaller angular range with a fixed number of beams.

BACKGROUND

The approach suggested herein utilizes a spherical lens that has perfect scanning properties and arranges the feed positions such that they do not interfere with each other and provide the need coverage range.

The disclosed antenna may be used in automotive radar applications. In the automotive radar arena there are two different radar systems, a 76-77 GHz band radar for automated cruise control that needs to cover a relatively small angular range (+/−7.5 degrees with approximately 3.5 degrees of resolution) from 20 to 150 meters in front of the vehicle (long-range radar) and a 24 GHz radar for parking assist, stop-go traffic assist, and collision avoidance that needs to cover a larger angular range (+/−80 degrees with approximately 10 degrees of resolutions) from 20 centimeters to 30 meters in front of the vehicle (short-range radar). Presently these two radar functions utilize two separate antennas. The purpose of this invention is to provide a single antenna aperture compatible with both these functions.

BRIEF DESCRIPTION OF THE INVENTION

The present invention provides a dual frequency radar system having a first radar transmitter/receiver set which operates in a relatively lower frequency band; a second radar transmitter/receiver set which operates in a relatively higher frequency band; and a spherical dielectric lens having a first array of feed points coupled with the first radar transmitter/receiver set and a second array of feed points coupled with the second radar transmitter/receiver set, the spherical dielectric lens forming relatively higher frequency beams that are relatively tightly spaced about a centerline of the spherical dielectric lens and the spherical dielectric lens forming relatively lower frequency beams that are relatively farther spaced about a centerline of the spherical dielectric lens than are the relatively higher frequency beams.

DETAILED DESCRIPTION OF THE INVENTION

Figure 1:
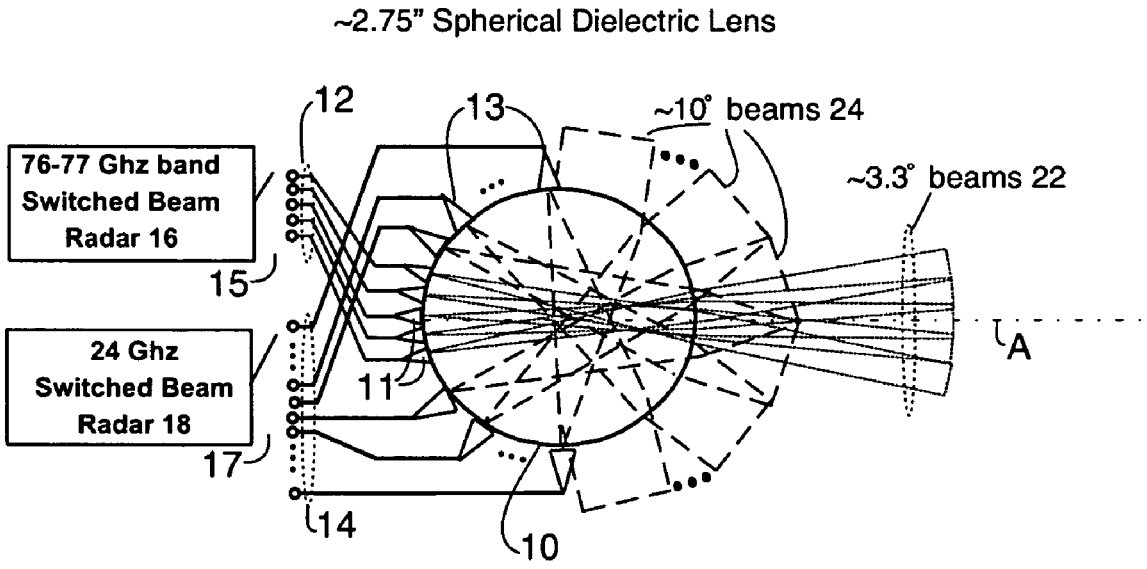
FIG. 1 is a schematic of the novel antenna structure described in this disclosure.

Turning to FIG. 1, an antenna structure is shown which includes a spherical lens 10, which may comprise either a Luneburg lens or a constant dielectric lens, with feed points 11, 13 located around its outer circumference. Relatively higher frequency (preferably in the 76-77 GHz band) feed lines 12 for a long-range radar 16 are coupled to feed points 11 located on the backside of the lens 10 near its center line A. In these positions the relatively higher frequency feed points 11 create beams 22 that provide overlay coverage in a relatively small angular range directly in front of the lens 10 near center line A.

Relatively lower frequency (preferably 24 GHz) feeds lines 14 for a short-range radar 18 are coupled to feed points 13 also located on the backside of the lens 10. But the lower frequency feed points 13 are located further away from center line A of the lens 10 than where the relatively higher frequency feed points 11 mentioned above. Since the relatively lower frequency feed points 13 are located further away from center line A of the lens 10, these feeds 13 create beams 24 that provide overlay coverage in a relatively large angular field of view in front of the lens 10 on either side of center line A.

The beamwidths of the beams produced will be different for the short-range and long-range radars. This is because the beamwidths are directly a function of the aperture's electrical size, which is considerably different for the two frequencies involved. The short-range to long-range radar beamwidth ratio will be approximately 76.5 GHz/24 GHz≈3 for the preferred frequencies mentioned above. This ratio of beamwidth for the two sets of frequencies happens to be the same as the ratio of angular resolution needed for the two radar functions and this relationship is what makes it possible to accomplish both these two radar functions using the same aperture 10. In the preferred embodiment beams 22 each have a 3.3° field of view (or beamwidth) while beams 24 each have a 10° field of view (or beamwidth).

The diameter of the spherical lens 10, for the frequencies discussed, may be about 2.75 inches. The beamwidths of the radiation patterns is a function of the sphere diameter in terms wavelength (its electrical diameter, as mentioned above). A first order formula for the required electrical diameter versus beamwidth is:

$$\text{beamwidth}=k\cdot(58°/D)$$

where k is a constant between 1 and 1.2 and D is the aperture diameter expressed in wavelengths. The value of the constant k is a function of the feed illumination and the focussing of the lens 10.

Figure 2:
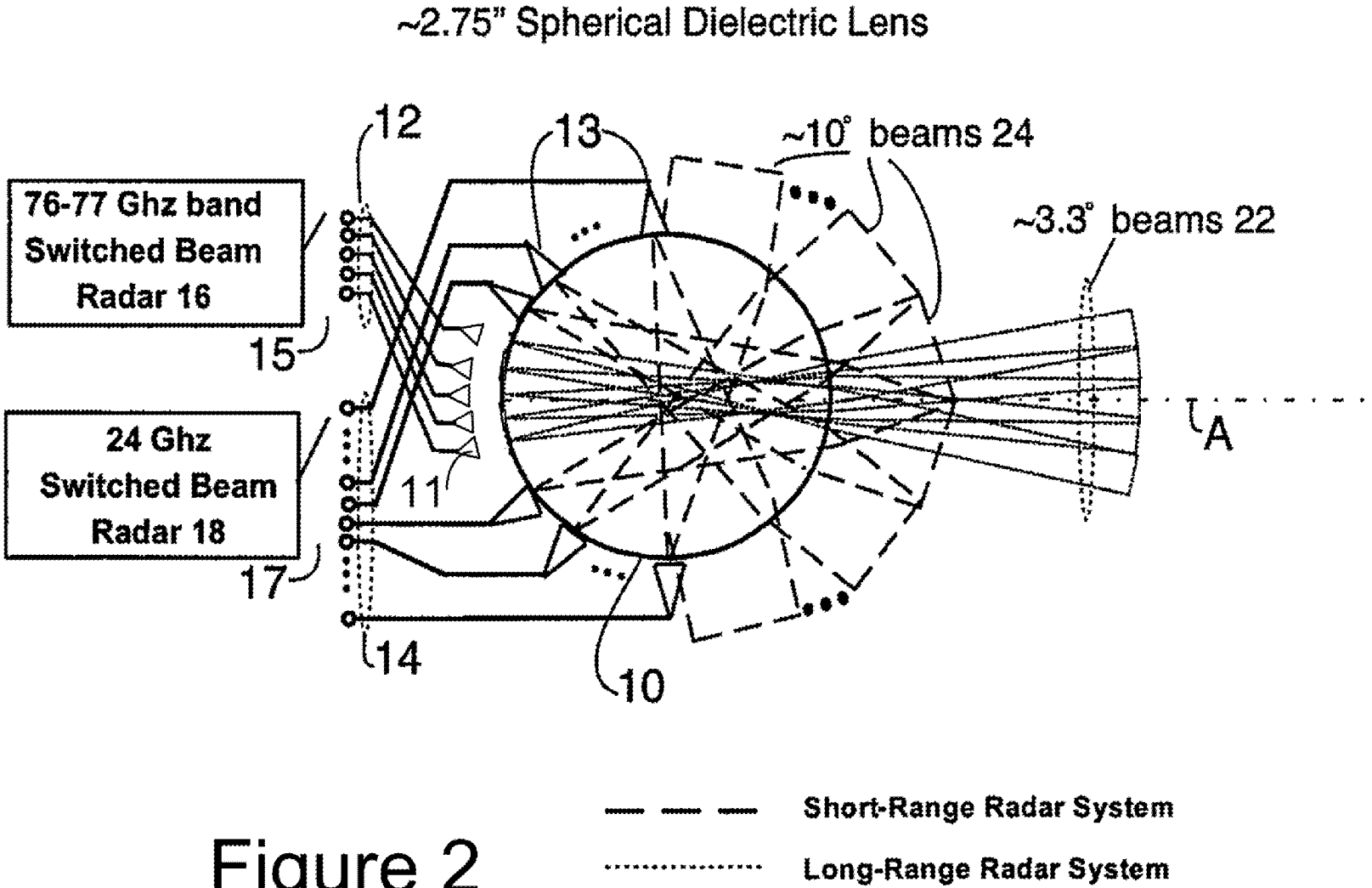
FIG. 2 shows feed points located off the surface of the lens according to an embodiment of this disclosure.

The dielectric constant of the lens 10 is important in determining the focal point of the lens 10. A Luneburg lens has perfect focussing on the surface of the spherical lens 10, while a constant dielectric lens has its best focusing point located some distance off the surface of the lens 10. The best focussing of a constant dielectric spherical lens is given by $$FD/R=n/[2\cdot(n-1)]$$

where FD is the distance from the center of the lens to the focal point, R is the radius of the lens, and n is the refractive index of the material of the lens, the refractive index being the square root of the relative dielectric constant of the lens material. This point gives the best focussing. The feed points are preferably located at the point of best focussing, but often the feed points may be located on the surface of the lens 10, if a constant dielectric lens is used and if the defocusing can be tolerated in the design be proposed. In FIG. 1 the focal points are depicted on the surface of the lens 10, but it needs to be observed that in some embodiments the focal points will be located off the surface of the sphere and the feed points will need to be similarly located off the surface of the sphere. FIG. 2 shows the feed points 11 located off the surface of the lens 10.

In FIG. 1 the view is a horizontal view, and if center line A corresponds to the axis of a vehicles, then some beams 22, 24 scan to the left side of the vehicle, while other beams scan to the right side of the vehicle. Of course, one or more beams can be aligned directly on the axis A of the vehicle. Additionally, FIG. 1 can also be looked at as if it were a side elevation view so that some beams 22, 24 can scan below or above the axis A. Since vehicles typically do not stay on flat, level ground, the beams 22, 24 preferably scan not only to the left and right, but also above and below a level horizontal axis.

The high frequency radar set 16 is connected to a plurality of feed points 11 disposed on the rear side of the lens 10 in a relatively tight array around or near axis A, while low frequency radar set 18 is connected to a plurality of feed points 13 disposed on the rear side of lens 10 in a relatively looser array around or near axis A, and generally speaking, the feed points 13 are usually spaced further from axis A along the circumference of lens 10 than are feed points 11. As previously mentioned, the feed points 11, 13 may or may not be on the surface of the lens 10 depending on whether the lens 10 is of the Luneburg type and, if not, depending on the amount of defocusing that can be tolerated.

The high frequency radar set 16 and the low frequency radar set 18 are each coupled to their respective feed points 11, 13 via switches 15, 17. The switches 15, 17 couple the antenna output/input of each radar set 16, 18 to a single feed point 11, 13 at any given radar signal transmit/receive time. So one radar set would be connected to a single feed point for a transmit/receive cycle, and then typically move onto another feed point for another transmit/receive cycle. The beams 22, 24 discussed above are discussed in terms of transmitting RF beams. Then in a receive mode, the numerals 22, 24 should be thought of as pointing to sensitivity lobes of a receiving antenna.

Having described this invention in connection with a preferred embodiment thereof, modification will now suggest itself to those skilled in the art. As such, the invention is not to be limited to the disclosed embodiment except as required by the appended claims. Some skilled in the art may characterize the disclosed antenna as being an aperture antenna. That term, as used herein and in the title hereof, is not intended as being limiting. Rather the scope of the invention is to be measured by the claims of the resulting US Patent.

What is claimed is:

1. A dual frequency radar system comprising:

a first radar transmitter/receiver set which operates in a relatively lower frequency band;

a second radar transmitter/receiver set which operates in a relatively higher frequency band;

a spherical dielectric lens having a surface and a center;

a first array of first feed points coupled with the first radar transmitter/receiver set, the first array of first feed points spaced about and on both sides of an axis through the center of the spherical dielectric lens; and a second array of second feed points coupled with the second radar transmitter/receiver set, the second array of second feed points centered on and spaced relatively tightly about the axis through the center of the spherical dielectric lens;

the spherical dielectric lens forming relatively higher frequency beams that are relatively tightly spaced about the axis of the spherical dielectric lens and the spherical dielectric lens forming relatively lower frequency beams that are relatively farther spaced about the axis of the spherical dielectric lens than are the relatively higher frequency beams.

2. The dual frequency radar system of claim 1 wherein the spherical dielectric lens is a Luneberg lens.

3. The dual frequency radar system of claim 1 wherein the spherical dielectric lens is a constant dielectric lens.

4. The dual frequency radar system of claim 1 wherein the first and second arrays are each two dimensional arrays arrayed on the surface of the spherical dielectric lens.

5. The dual frequency radar system of claim 1 wherein the first array of first feed points are sequentially coupled to the first radar transmitter/receiver set via a first RF switch and wherein the second array of second feed points are sequentially coupled to the second radar transmitter/receiver set via a second RF switch.

6. The dual frequency radar system of claim 1 wherein:

each first feed point is arranged at a first radius from the center of the spherical dielectric lens; and each second feed point is arranged at a second radius from the center of the spherical dielectric lens.

7. A dual frequency radar antenna for connection to a first radar transmitter/receiver set which operates in a relatively lower frequency band and to a second radar transmitter/receiver set which operates in a relatively higher frequency band, the dual frequency radar antenna comprising:

a spherical dielectric lens having a first array of first inputs coupled with the first radar transmitter/receiver set, the first array of first inputs spaced about and on both sides of an axis through a center of the spherical dielectric lens and a second array of second inputs coupled with the second radar transmitter/receiver set, the second array of second inputs centered on and spaced about the axis through the center of the spherical dielectric lens, the spherical dielectric lens forming relatively higher frequency beams that are relatively tightly spaced about the axis of the spherical dielectric lens and the spherical dielectric lens forming relatively lower frequency beams that are relatively farther spaced about the axis of the spherical dielectric lens than are the relatively higher frequency beams.

8. The dual frequency radar antenna of claim 7 wherein the spherical dielectric lens is a Luneberg lens.

9. The dual frequency radar antenna of claim 7 wherein the spherical dielectric lens is a constant dielectric lens.

10. A method of forming a dual frequency radar beam comprising:

(a) generating a first radar signal in a relatively lower frequency band;

(b) generating a second radar signal in a relatively higher frequency band; and (c) sequentially applying the first radar signal to a first array of feed points disposed on a dielectric lens, the first array of feed points spaced about and on both sides of an axis through a center of the dielectric lens; and (d) sequentially applying the second radar signal to a second array of feed points disposed at said dielectric lens, the second array of feed points centered on the axis through the center of the dielectric lens;

wherein the first array of feed points are disposed in a relatively loosely spaced array on said dielectric lens and the second array of feed points are disposed in a relatively tightly spaced array at said dielectric lens.

* * * * *